US008196900B2

(12) United States Patent
Kempf

(10) Patent No.: US 8,196,900 B2
(45) Date of Patent: Jun. 12, 2012

(54) ZERO FLEET WINCH FOR STAGE USE

(75) Inventor: James Kempf, Wallkill, NY (US)

(73) Assignee: Production Resource Group, L.L.C, New Windsor, NY (US)

( * ) Notice: Subject to any disclaimer, the term of this patent is extended or adjusted under 35 U.S.C. 154(b) by 243 days.

(21) Appl. No.: 12/484,188

(22) Filed: Jun. 13, 2009

(65) Prior Publication Data

US 2009/0309081 A1 Dec. 17, 2009

Related U.S. Application Data

(60) Provisional application No. 61/061,403, filed on Jun. 13, 2008.

(51) Int. Cl.
*B66D 1/00* (2006.01)

(52) U.S. Cl. ..... 254/385; 254/383; 254/338

(58) Field of Classification Search ..... 254/385, 254/383, 374, 338, 371
See application file for complete search history.

(56) References Cited

U.S. PATENT DOCUMENTS

| | | | | | |
|---|---|---|---|---|---|
| 1,172,418 | A * | 2/1916 | Wolfe | 242/397.2 |
| 2,933,264 | A * | 4/1960 | Jefferson et al. | 242/157.1 |
| 3,144,998 | A * | 8/1964 | Back | 242/157.1 |
| 3,598,334 | A * | 8/1971 | Fleischer | 242/277 |
| 4,767,073 | A * | 8/1988 | Malzacher | 242/414 |
| 5,669,575 | A * | 9/1997 | Byle | 242/470 |
| 6,443,431 | B1 * | 9/2002 | Stasny et al. | 254/385 |
| 6,811,112 | B1 * | 11/2004 | Currie et al. | 242/534.1 |
| 6,983,927 | B2 * | 1/2006 | Pelletier et al. | 254/385 |
| 7,104,492 | B1 * | 9/2006 | Massell et al. | 242/397 |
| 7,118,094 | B2 * | 10/2006 | McDaniel et al. | 254/335 |
| 7,234,685 | B2 * | 6/2007 | Britten | 254/385 |
| 7,370,823 | B2 * | 5/2008 | Lammermann et al. | 242/397.2 |
| 7,380,742 | B2 * | 6/2008 | Stevens | 242/397.3 |
| 7,478,795 | B2 * | 1/2009 | Grapes et al. | 254/333 |
| 7,607,644 | B1 * | 10/2009 | Gibb et al. | 254/383 |
| 7,748,685 | B2 * | 7/2010 | Richards | 254/385 |

* cited by examiner

*Primary Examiner* — Emmanu M Marcelo
(74) *Attorney, Agent, or Firm* — Law Office of Scott C Harris Inc

(57) ABSTRACT

A zero fleet winch with guides that move while a cable is wound on a drum. The guides hold the cable always at 90 degrees to the drum. A tensioning turnaround sheave keeps the cable tight.

13 Claims, 4 Drawing Sheets

ZERO FLEET WINCH FOR STAGE USE

This application claims priority from provisional application No. 61/061,403, filed Jun. 13, 2008, the entire contents of which are herewith incorporated by reference.

BACKGROUND

Winches can be used to move various objects and scenery, especially in a stage environment.

In some applications, it becomes important that cable which comes on and off of the winch is always at a precisely same (usually orthogonal) angle relative to the drum.

SUMMARY

Exemplary embodiments describe a zero fleet winch that always keeps the cable coming on and/or off the drum at a constant angle, usually perpendicular to the axis of rotation of the drum.

DETAILED DESCRIPTION

In an embodiment, the drum includes a groove for the cable such that each row of cable is wound into a specific groove on the drum. In order to facilitate that winding, the cable should be positioned so that it is incident exactly at the groove location no matter where the winding is being carried out.

Figure 1:
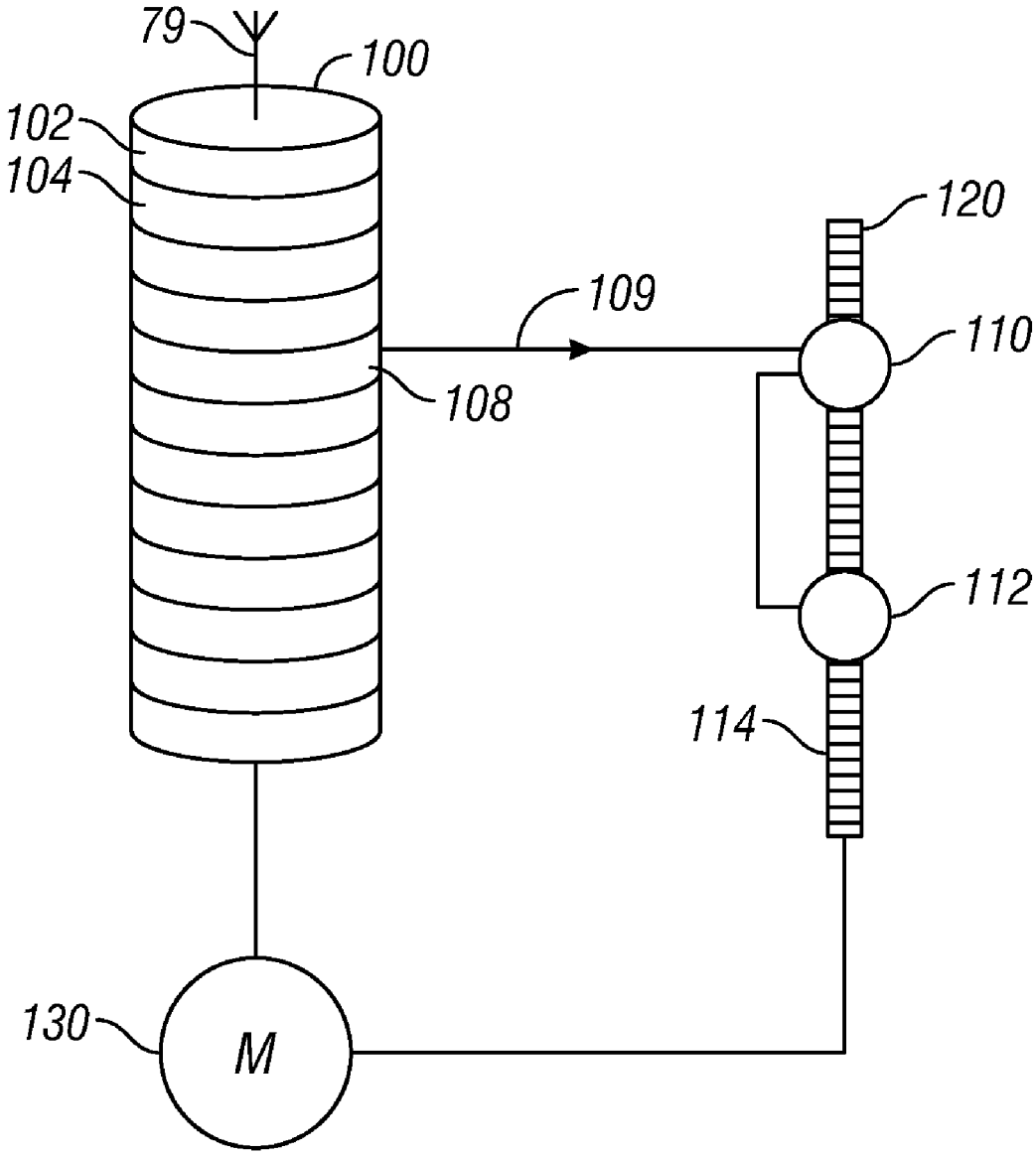
FIG. 1 shows an operative diagram of the winch.

FIG. 1 illustrates an embodiment showing a number of spiral grooves 102, 104 on a drum 100 that rotates around an axis 99. While only a few grooves are shown on the drum, it should be understood that there can be any number of groove locations on the drum formed by the spiral path on the drum.

Each groove location is intended to receive a single "row" of cable wound thereon. In the embodiment shown in FIG. 1, cable is wound up to the point 108, which is the point where cable is paying on and/or off the drum as 109. The cable which pays on and off the drum is coupled to a sheave assembly 120. The sheave assembly includes a first sheave 110 and a second sheave 112, both mounted on a common support 114, and preferably which move in sync with one another. The support 114 is a lead screw in an embodiment, and in the embodiment, the threads of the screws are timed to the pitch of the grooves 102, 104 on the drum. In another embodiment, the support may be a machined part with timing marks that keep the parts synchronized.

The sheave 112 can receive a second cable to go on or off the drum 100 or on or off some other drum. The second sheave is synced and/or timed to the first sheave 110.

Both the drum 100 and the screw 114 are commonly rotated by a rotation motor 130. The screw and drive is set such that the first and second sheaves 110, 112 move at the same speed and direction as the drum. This keeps the fleet angle off the drum 100 always at zero (or at some other defined value). The sheaves move in sync with the position of the drum, and are referred to in this application as "walking" sheaves.

Figure 2:
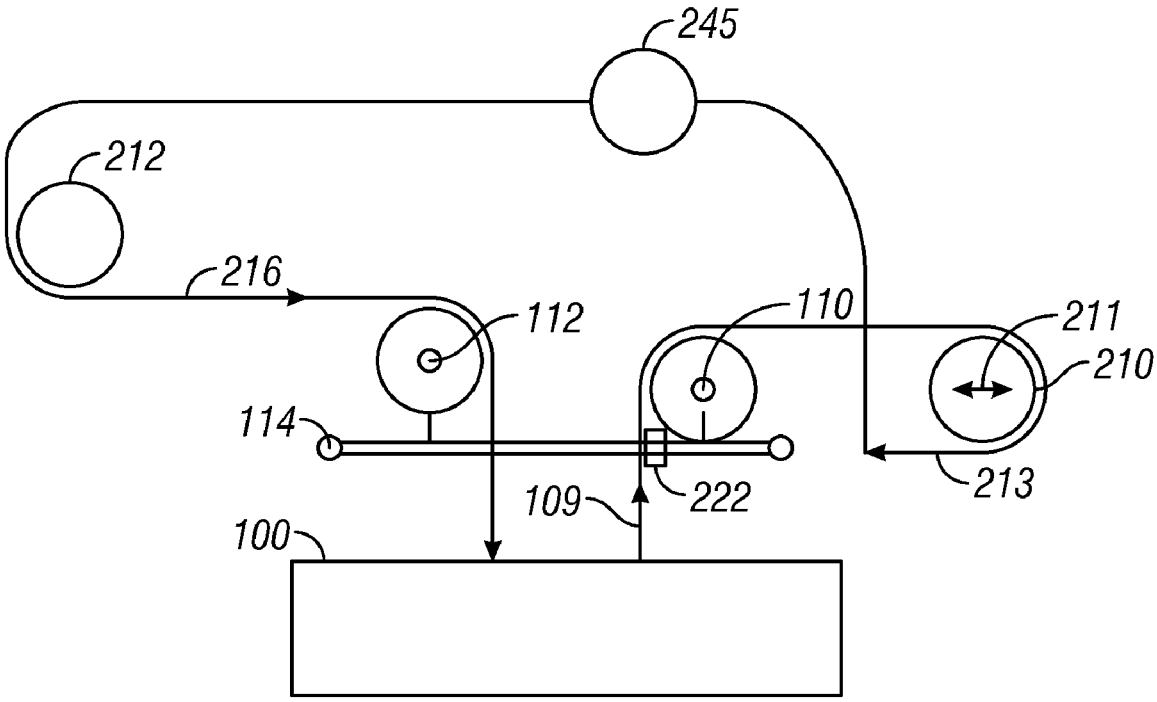
FIG. 2 shows the arrangement of the cable as it goes on and off the winch.

FIG. 2 illustrates an alternative embodiment of the cable 109 paying on/off the drum 100. The cable 109 is guided by the first sheave part 110, then wound around a first cable tensioning sheave 210. The cable tensioning sheave 210 is movable as shown by arrow 211, to produce tension on the cable. In this embodiment, the outgoing cable being released is shown as 213 which is sent to the item being driven 245.

In one embodiment, cable is taken on to another area of the drum 100 as 216. This may be the same loop of cable that has been released. This can effect a motion of an item, e.g., to different lateral positions held by an infinite loop of cable. The cable 216 is tensioned by second tensioner 212, then sent to the second sheave 112, and wound back onto the drum 100. The tensioner ensures that tightness is maintained within the cable.

The lead assembly 114 holds the two sheaves 110, 112, and sets the timing between the movement of those sheaves. One or more nuts 222 may also be provided to set the positioning of the cable.

In another embodiment, the system of FIG. 2 simultaneously releases two different cables from two different spots on the drum 100, to carry out a haul of some item at two different locations.

Figure 3:
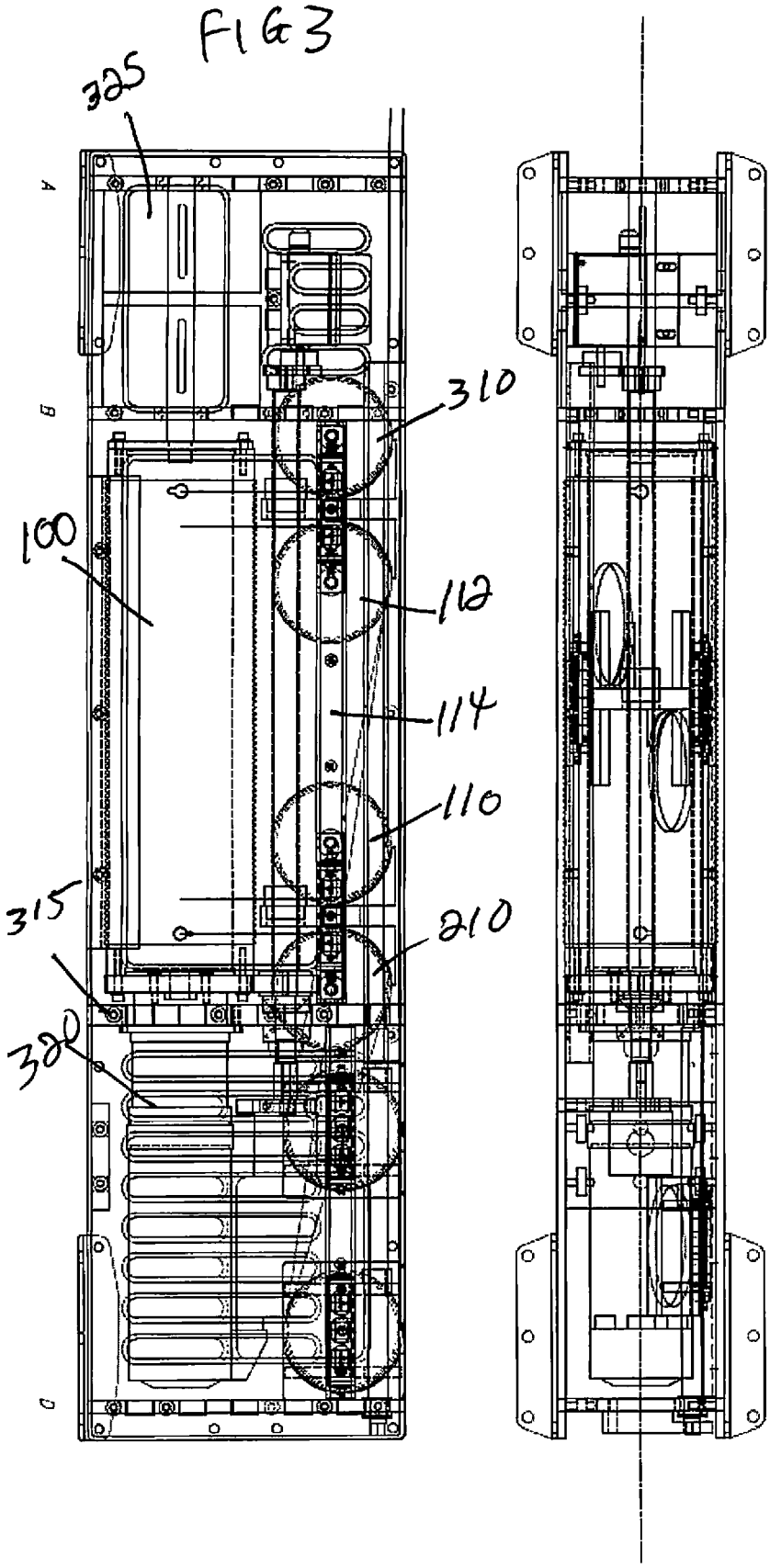
FIG. 3 shows locations of the parts from the side.

While the above FIG. 2 shows only a single tensioning sheave, in the embodiments there may be many such tensioning sheaves. FIG. 3, for example, shows the packaged winch with the drum, sheaves 110, 210, the return sheave 112, and an additional tensioning sheave 310. 114 sets the timing between the two sheave. Moreover, both the lead screw and the drum 100 are commonly rotated by a rotation device 315 that is driven by the motor 320.

A separate safety brake 325 may also be provided, mounted directly to the drum, to terminate the rotation, as necessary for safety. A separate brake of this type may be necessary when using the winch for dead hauls.

Figure 4:
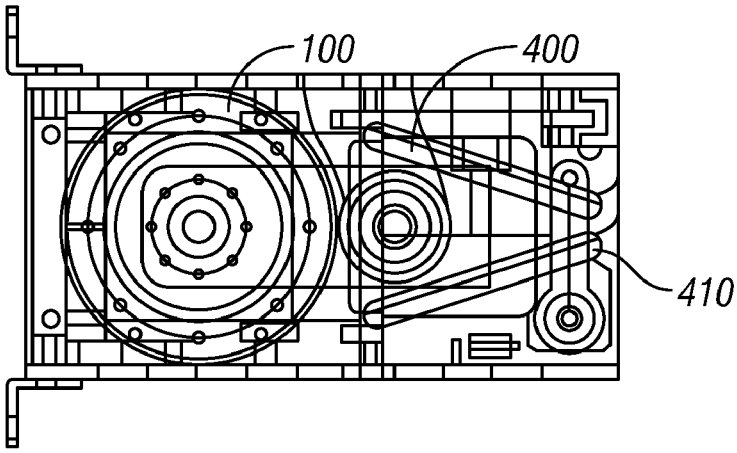
FIG. 4 shows locations of those parts from the bottom.

Note that even though the line pays out at a precise orthogonal angle relative to the drum, this orthogonal angle is relative to the axis 99 of the drum. In the orthogonal direction/drum axis, the cable actually pays out on tangent angles to the drum in the direction of the drum axis. FIG. 4 illustrates how the drum 104 has cable paying out at a first tangent 400, and a second tangent 410, respectively from top and bottom.

This can be used, for example, for a dead haul, where two cables are used instead of one. A quarter inch cable, for example, may have a 720 pound rating, and may be used to lift 500 pounds. However, using two cables can double the effective hauling capability, thereby allowing hauling twice as much payload with the same size cable.

Figure 5A:
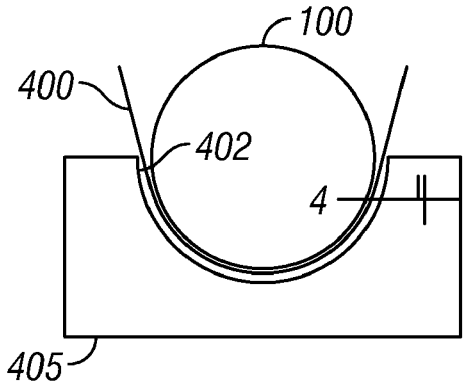
FIGS. 5A and 5B show how the cable is held on the drum.
Figure 5B:
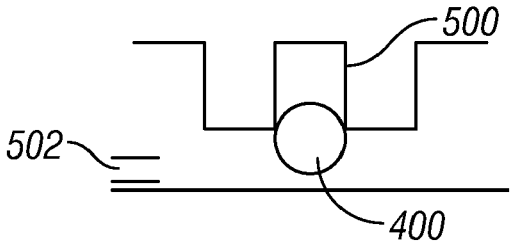

FIGS. 5A and 5B show the drum 100 mounted within the cable keeper. The cable keeper may be formed of plastic spaced from the drum, to hold the cable in place in a specified way. For example, FIG. 5A illustrates how the drum 100 can be rotated near the keeper. Cable 400 comes into the opening 402 between the drum and the keeper 405. This holds the cable in place on the drum.

A cross-section along the lines 4-4 is shown in FIG. 5B. This shows how the surface of the keeper includes notches 500 which hold the cable into place on the surface of the drum. A quarter inch cable may be provided with 1/16th of an inch clearance 502. More generally, the clearance only needs to be small enough so that the cable cannot jump from groove to groove.

In one embodiment, however, triple turnaround sheaves are used. However, more generally, any tensioning turnaround sheave that allows slack, loosen and tightening of the cable can be used.

Two different sizes are contemplated in the embodiments, a "zero fleet" winch and a "sub zero" winch. The sub zero is a compact, high speed, zero fleet winch for low to medium duty applications with integral secondary brakes and cable tensioning Dimensional goals—
Length: 48" (54.67" with IJ box)
Width: 6.375"
Depth: 12"
Weight: approx. 150 lbs
Operating parameter targets—
Max load speed: 6.75 fps
Max line pull: 209 lbs
Max load travel: 97'
Examples of winch applications—
Driving items along traveler tracks (one cable part goes on while the other cable part goes off)
Driving counterweight assist line sets (e.g., both cables on or off)
Driving lighter duty deck tracks
Dead hauling small scenic units or soft goods
Winch mounting—
The sub zero winch can mount horizontal or vertical above a surface with the modular steel angle brackets.
The sub zero winch can mount vertical above a surface with a mule stand.
The sub zero winch can mount above stock flat truss with custom live end sheave unit and a half cheeseboro clamp.
Winch shipping and handling—
When not permanently mounted to a truss, up to 7 winches can be strapped/shrink wrapped together in one row on a standard wood pallet.
Winch accessories—
The sub zero winch has accessory steel mounting brackets that can be welded to venue structure and discarded if necessary.
The sub zero winch has a custom mule stand to direct the cables in any direction vertical or horizontal.
The sub zero winch has an accessory live end sheave mount for use with a flat truss.
Rigging access and operation—
Cable entrance key holes in first full groove both sides of drum locked with ½" NPT plugs.
Cables terminated with Nicopress end stops.
Top and sides of winch are open for easy access to drum.
For rigging individual winches prior to the control system arrival at the venue, a 120VAC control box releases the three brakes and spins the drum at half speed max in order to rig the winch. Also possible is a 120VAC brake release only, without a drive.
Electrical access—
motor/brake cable connects to IJ box panel mount on the back of winch
universal feedback cable connects to IJ box panel mount on the back of winch
Limit box, motor, secondary brakes, and secondary encoder are hard wired to fittings on the panel of the IJ box.
Disconnect switch in IJ box is located on the back of winch
IJ box is fastened between the cheek plates with four small screws. By removing the screws and releasing the tails, the entire electrical assembly can be removed from the winch.

List of purchased mechanical parts (fastening hardware not included)—

Motor—Allen Bradley MPL-A430P
Gearbox—Alpha TP010 16:1 (Could also be Stober PH422)
Drum Gear—Martin S1266 modified
Acme gear—Martin S1230 modified and sweated to screw
Secondary encoder—Stegman
Drive screw and nut—Nook 1-10 Acme modified
Tensioner screw and nut—¾-10 Acme modified
Secondary brakes—Mayr Robastop Z size 60 (no manual release handle)
Screw bearings—Timken ¾" id (A6075-A6162)
Shaft-screw bearings—1" General 23216-88
Limit box—TER MF2C 100:1
Limit box driver gear—Martin S2032 ½" bore KWSS
Limit box driven gear—Martin S2032 8 mm bore DSS
Drive screw to encoder coupling—Climax ISCC-037-037-A.
Linear guide bearings—Rollon NT28
Linear guide rails—Rollon TLC28
Sheave bearings—General R14
Tension screw bearings—Symmco SS-2028-12
List of CNC cut and then machined aluminum parts—
½" cheek plate right E
½" cheek plate left F
½" core plate A
½" core plate B
¾" core plate C
½" core plate D
¼" limit plate
½" limit mount
½" encoder tab
⅜" sheave blanks
¾" tensioner lock
⅜" mule top
⅜" mule base
⅜" mule cheeks
½" cheeseboro mount
¾" carriage plate
⅜" carriage cable guides
¼" tensioner sheave plate
⅜" tensioner sheave keeper
⅜" tensioner sheave tabs
List of CNC cut and then machined steel parts—
⅜" steel brake shaft-drum mount
3/16" steel feet
List of machined only parts—
1" steel brake shaft
2" nylatron cable keeper
Ta1×1.5 wire race
1" alum stock bearing posts
List of automation shop parts—
Sheet metal IJ box
Local hard wired tails to motor, limit box, secondary brakes, and secondary encoder
Target winch speed calculation—
4300 rpm motor speed divided by 16:1 gearbox equals 269 rpm gearbox output/drum speed multiplied by a 18" drum circumference per revolution equals 4859 inches per minute divided by 12" inches per foot and 60 second per minute equals a line speed of roughly 6.75 feet per second.
Target winch line pull calculation—
A 40 inlbs motor into a 16:1 gearbox produces 640 inlbs of torque multiplied by 94% gearbox efficiency equals 602 inlbs at the drum. The 602 inlbs divided by a drum radius of 2.88" yields 209 lbs of line pull at full speed.
Target winch travel calculation—

A 5.75" diameter drum 15.1" wide with 0.22" lead for 3/16" cable has roughly 69 complete wraps minus 4 safety wraps equals 65 active wraps multiplied by 18 inches per wrap equals 1170 inches divided by 12 inches per foot equals 97' max load travel.

The zero fleet winch dimensional goals are as follows:

Length: 22"

Width: 10.25"

Height: 46"

Weight: 350 lbs

Operating parameter targets (operating loop configuration)—

Max load speed: 7.5 fps

Max load line-pull: 473 lbs

Max load travel: 115'

Operating parameter targets (point hoist configuration)—

Max load speed: 2.9 fps

Max load line-pull: 1247 lbs

Max load travel: 70'

Examples of winch applications—

Driving counterweight assist line sets

Driving heavy duty deck tracks

Driving heavy duty travelers

Dead hauling heavy scenic units, electrics, video walls, or performers

Winch mounting—

Horizontal above/below/beside surface with custom mounts

Vertical above/below/beside surface or truss with custom mounts

Vertical below structure on soft picks

The dual Unistrut mounting rails and rows of tab picks top and bottom allow for many variable mounting options.

Winch shipping and handling—

When not built into a larger truss assembly, up to four Zero Fleet winches can travel strapped/shrink wrapped to a standard wood pallet.

The tab holes along the top and bottom of the winch are strong enough to be used as rigging/lifting points.

Rigging access and operation—

For operating loop configuration there are opposing cable entrance holes near both ends of drum For point hoist configuration there are dual cable entrance holes, on near the middle and one near the end of the drum.

Since access to interior of the drum is restricted, cables are terminated with end stops in keyholes secured with tapered plugs.

Two openings in each cheek plate allow access to cable entrance holes.

For rigging individual winches prior to the control system arrival at the venue, PRG will provide a 120VAC control box that will release the brakes and spin the drum at half speed max in order to rig the winch.

Electrical access—

PRG motor/brake cable connects to "black box" panel mount on the side of the winch PRG universal feedback cable connects to "black box" panel mount on the side of the winch Limit box, motor, secondary brake, and absolute encoder are hard wired to fittings on the side of the "black box"

Disconnect switch in "black box" is located on the side of the winch

Black box is fastened between the cheek plates with four small screws. By removing the screws and releasing the tails, the entire electrical assembly can be removed from the winch.

List of purchased mechanical parts (fastening hardware not included)—

Motor—Allen Bradley MPL-A540P

Gearbox—Stober F402 35:1 or 13.6:1 depending on configuration

Acme screw driven sprocket—Martin 35BS28 (modified)

Acme screw driver sprocket—Martin 35A25

Torque clutch—Martin TT25BS1

Drum hubs—Martin 40SH32 (modified)

Drum shaft bottom bearing—SKF 6007-2SR1-NR

Limit box—Cutler hammer 103:1

Limit box/encoder driver—Martin 35BS20 (modified)

Limit box driven—Martin 35BS14

Limit box chain—#35

Absolute encoder—Sick-Stegman ATM 60

Absolute encoder driven—Martin 35BS11

Acme nut—Nook 20104

Acme screw—Nook 12104 (modified)

Sheave carriage bearings—Rollon NT43

Sheave carriage guides—Rollon TLV43

Acme top bearing—tapered roller pending

Acme bottom bearing—tapered roller pending

Secondary brake—Mayr Silenzio 200

List of CNC cut and then machined aluminum parts—

Outer dual sheave plate

Top plate

Rollon bearing mounts

Inner dual sheave plate

Bottom plate

Turn around tabs (not machined after CNC)

Drum center plates

Keeper cams

Sheave blanks

Outer single sheave plate

Inner single sheave plate

Motor guard plate

Cable lock (not machined after CNC)

Cheek plate left

Cheek plate right

List of machined only parts—

Winch drum

Acme nut mounts

Keeper mounts

Drum shaft

Keeper rollers

Keeper shafts

Delrin bushings

List of automation shop parts—

Sheet metal black box

Local hard wired tails to motor, limit box, secondary brake, and absolute encoder List of subcontracted parts or services—

Powder coating or anodizing of aluminum parts

Target winch speed calculation (operating loop configuration)—

3400 rpm motor speed divided by 13.6:1 gearbox equals a drum speed of 250 rpm multiplied by a 21.6" drum circumference per revolution equals 5400 inches per minute divided by 12" inches per foot and 60 second per minute equals a line speed of roughly 7.5 feet per second.

Target winch line pull calculation (operating loop configuration)—

A 130 inlbs motor into a 13.6:1 gearbox produces 1768 inlbs of torque multiplied by 94% gearbox efficiency equals 1662 inlbs at the drum shaft divided by a drum radius of 3.44" yields 483 lbs of line pull.

Target winch travel calculation (operating loop configuration)—

A 6.88" diameter drum 19" wide with 0.28" lead for ¼" cable has roughly 68 complete wraps minus 4 safety wraps equals 64 active wraps multiplied by 21.6 inches per wrap equals 1382 inches divided by 12 inches per foot equals 115' max load travel.

Target winch speed calculation (point hoist configuration)—

3400 rpm motor speed divided by 35.1:1 gearbox equals a drum speed of 97 rpm multiplied by a 21.6" drum circumference per revolution equals 2092 inches per minute divided by 12" inches per foot and 60 second per minute equals a line speed of roughly 2.9 feet per second.

Target winch line pull calculation (point hoist configuration)—

A 130 inlbs motor into a 35.1:1 gearbox produces 4563 inlbs of torque multiplied by 94% gearbox efficiency equals 4289 inlbs at the drum shaft divided by a drum radius of 3.44" yields 1247 lbs of line pull on dual ¼" cables.

Target winch travel calculation (point hoist configuration)—

A 6.88" diameter drum 12" wide with 0.28" lead for ¼" cable has roughly 43 complete wraps minus 4 safety wraps equals 39 active wraps multiplied by 21.6 inches per wrap equals 842 inches divided by 12 inches per foot equals 70' max load travel on dual ¼" cables.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example, other sizes, materials and connections can be used. Also, the inventors intend that only those claims which use the-words "means for" are intended to be interpreted under 35 USC 112, sixth paragraph. Moreover, no limitations from the specification are intended to be read into any claims, unless those limitations are expressly included in the claims.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

What is claimed is:

1. A winch device, comprising:

a roller, which has a surface that holds a cable thereon, where said roller is rolled to wind and unwind cable on and from said surface of said roller, and where said cable is wound to be removed and/or wound on said roller at a first location and a second location, where said first location and said second location are different and spaced locations on said roller;

a cable guiding device, separate from said roller, and having first and second cable guiding portions, each of which guide cable on and off of said roller, said first cable guiding portion adjacent said first locations on said roller, and where cable from said roller is wound between said first location and said first cable guiding portion, and the second guiding portion adjacent said second location of said roller and receiving cable there from, said cable guiding portions being movable relative to said roller, and moving such that both said first and second cable guiding portions stay a same relative distance from one another in all positions when said guiding device is moved;

a rotation device, which is energized to rotate said roller, and also rotates said cable guiding device in a synchronized manner with said roller, in a way that keeps both said first and second locations and said first and second cable guiding portions at specified positions relative to one another as said cable is wound on and off said roller; and tensioning sheaves which are round in outer shape, and which tension the cable between said first and second guiding portions and said roller by winding said cable around at least a portion of an outer round shape of said tensioning sheaves.

2. A winch device as in claim 1, wherein one of said cable guiding portions guides cable off said roller, while an other of said cable guiding portions guides cable to go on said roller.

3. A winch device as in claim 1, wherein said first cable guiding portion and said second cable guiding portion both guide cable to either roll on to said roller at the same time, or to roll off said roller at the same time.

4. A winch device as in claim 1, wherein there are at least multiple of said tensioning sheaves, and wherein at least one of said tensioning sheaves moves in synchronism with said roller.

5. A device as in claim 1, wherein said cable guiding device keeps both said first and second locations of cable at substantially 90° angles relative to said roller, at all positions of rolling and unrolling said cable.

6. A device as in claim 5, further comprising a device that constrains said cable in a second angular direction different than a 90 degree angle.

7. A device as in claim 1, wherein said cable is rolled onto said roller with a single roll of cable or single layer of cable on said roller at all positions.

8. A device as in claim 7, wherein said cable guiding device keeps both said first and second locations of cable precisely at said locations on said roller at all times as said cable goes on and/or off of said roller.

9. A device as in claim 7, further comprising a second guide which leaves a space between said roller and said guide such that said cable is allowed to roll onto said roller, but is constrained by said second guide.

10. A device as in claim 7, wherein said roller includes notches thereon, said notches formed in a manner such that each notch portion holds said cable in said notches.

11. A device as in claim 1, wherein said cable guiding device is threaded on a lead screw that has screw pitches that are timed to cause the cable guiding device to move in synchronism with said cable going on and off said roller.

12. A method, comprising:

rolling cable on and off of two positions on a roller simultaneously;

rotating said roller to wind said cable; and automatically moving a cable guiding device, separate from said roller based on force used for rotating said roller, said cable device having first and second cable guiding portions, each of which guide cable on and off of said roller, said first guiding portion adjacent a first location on said roller, and where cable from said roller is wound between said first location and said first cable guiding portion, and the second guiding portion adjacent a second location of said roller and receiving cable there from, said cable guiding device being movable relative to said roller, and moving such that both said first and second cable guiding portions stay a same relative distance from one another in all positions when said cable guiding device is moved;

maintaining a tension on said cable, using a sheave, wherein the at least one portion of the sheave is also moved when the roller is moved, and at least one portion of the sheave includes a round outer surface around which said cable is wound for tensioning.

13. A method as in claim 12, wherein said cable guiding device is threaded on a lead screw that has screw pitches that are timed to cause the cable guiding device to move in synchronism with said cable going on and off said roller.

* * * * *